United States Patent [19]

Palac

[11] Patent Number: 4,721,879

[45] Date of Patent: Jan. 26, 1988

[54] TENSED MASK CATHODE RAY TUBE

[75] Inventor: Kazimir Palac, Carpentersville, Ill.

[73] Assignee: Zenith Electronics Corporation, Glenview, Ill.

[21] Appl. No.: 835,428

[22] Filed: Mar. 3, 1986

Related U.S. Application Data

[63] Continuation of Ser. No. 538,003, Sep. 30, 1983, abandoned.

[51] Int. Cl.[4] ..... H01J 29/80; H01J 31/00

[52] U.S. Cl. ..... 313/402; 313/408; 313/482

[58] Field of Search ..... 313/402, 406, 407, 408, 313/348, 482; 445/29, 30

[56] References Cited

U.S. PATENT DOCUMENTS

| | | | |
|---|---|---|---|
| 2,625,734 | 1/1953 | Law | 29/25.13 |
| 2,761,990 | 9/1956 | Amdursky et al. | 313/70 |
| 2,813,213 | 11/1957 | Cramer et al. | 313/78 |
| 2,842,696 | 7/1958 | Fischer-Colbrie | 313/78 |
| 2,905,845 | 9/1959 | Vincent | 313/78 |
| 3,284,655 | 11/1966 | Oess | 313/348 |
| 3,440,469 | 4/1969 | Bradu et al. | 313/89 |
| 3,489,966 | 11/1970 | Bradu et al. | 313/83 |
| 3,638,063 | 1/1972 | Tachikawa et al. | 313/348 |
| 3,719,848 | 3/1973 | Bradu | 313/853 |
| 3,873,874 | 3/1975 | Shinal | 313/402 |
| 3,894,321 | 7/1975 | Moore | 29/25.15 |
| 3,898,508 | 5/1975 | Pappadis | 313/405 |
| 4,069,567 | 1/1978 | Schwartz | 29/25.15 |
| 4,100,451 | 7/1978 | Palac | 313/404 |
| 4,551,651 | 11/1985 | van der Ven | 313/402 |
| 4,593,224 | 6/1986 | Palac | 313/402 |
| 4,593,225 | 6/1986 | Dietch et al. | 313/402 |
| 4,614,892 | 9/1986 | Palac | 313/402 |

FOREIGN PATENT DOCUMENTS

| | | |
|---|---|---|
| 1477706 | 3/1967 | France . |
| 54-8454 | 1/1979 | Japan . |
| 1163495 | 9/1969 | United Kingdom . |
| 2052148 | 1/1981 | United Kingdom . |

*Primary Examiner*—S. Leon Bashore
*Assistant Examiner*—Michael K. Boyer
*Attorney, Agent, or Firm*—Cornelius J. O'Connor

[57] ABSTRACT

A novel color selection electrode assembly is utilized in screening a pattern of phosphor areas upon the faceplate of a color cathode ray tube. The faceplate, which is formed of a material having a predetermined temperature coefficient of expansion, has registration affording means. The aforesaid assembly comprises an auxiliary mount formed of a material having a temperature coefficient of expansion greater than that of the faceplate and has a central opening of such span as to enable the mount to surround the periphery of the faceplate. Index bosses, cooperable with the faceplate registration affording means, are detachably secured to the mount. A planar metal foil having a predetermined pattern of apertures and formed of a material having a temperature coefficient of expansion not greater than that of the mount is secured to the mount. The index bosses cooperate with the registration affording means on the envelope to permit repeated precise registrations between the foil and the faceplate to facilitate screening of the phosphor pattern as well as to facilitate mating of the electrode assembly to the faceplate. Finally, the invention contemplates a method of utilizing the electrode assembly for screening a phosphor pattern as well as methods of making a color cathode ray tube having such an electrode assembly.

4 Claims, 6 Drawing Figures

TENSED MASK CATHODE RAY TUBE

This application is a continuation of application Ser. No. 538,003, filed Sept. 30, 1983 now abandoned.

BACKGROUND OF THE INVENTION

This invention relates in general to color cathode ray tubes, and to a color selection electrode assembly for use therein. Of equal significance, the invention is concerned with methods of manufacturing the electrode assembly as well as a cathode ray tube utilizing the assembly.

In general, a color selection electrode or "shadow mask" is a device which is disposed adjacent the luminescent phosphor screen that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas by those beams. The choice of a color selection electrode for use in color television cathode ray tubes is, by and large, a choice between a non-tensed electrode and a tensed electrode. The most common type of color selection electrode used in color television receivers today is the non-tensed type.

In color picture tubes utilizing an untensed shadow mask, there is a tendency on the part of the mask to "dome" (localized buckling) in those areas where a scene characterized by very high brightnes is depicted. For example, in a sence where a high concentration of white is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", an untensed mask cannot accommodate the power density that a "doming-resistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color televison manufacturer. In that tube, the color selection electrode comprises a grid formed of a multitude of parallel conductors tensed across a rigid frame. This grid serves to mask the writing beams to fall upon the desired light emitting phosphor.

The mask supporting frame is mechanically stressed, as by compressing it, prior to attaching the shadow mask thereto. Upon release of the compression force, restoration forces in the frame establish tension in the mask.

An advantage of utilizing a tensed mask resides in the fact the mask, while under tension, will not "dome". The mask retains its desired configuration during normal operating conditions.

Under extreme tube operating conditions however, electron bombardment of a tensed mask can cause a series of grids of the mask to relax and cause color impurities. A cathode ray tube utilizing a tensed mask of the type adverted to above, the Sony Trinitron, is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask. However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when one goes to a 10 to 12 mil mask the aperture etching process is much more different Specifically, in order to prevent aperture limiting of the beam at the outer reaches of the mask, as would be encountered in a 90 degree tube, the apertures have to be etched at an angle to the plane of the mask, rather than etched substantially perpendicular to that plane as is the case for a conventional curved mask.

DISCUSSION OF OTHER PRIOR ART

An early example of a tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, control the passage therethrough of a stream of electrons. From a structural standpoint, it is proposed that mesh storage screen be affixed (no details given) to a circumferential ring that is disposed across the open end of envelope member. One end of the ring is in contact with the edge of the envelope member which has a coating of glass frit applied thereon. The end wall of another envelope member, also coated with frit, is placed in contact with the other side of the ring so that the end walls of the envelope members now abut both sides of the ring. Thereafter this assembly is frit sealed to secure the ring and mesh target within the tube.

It is of particular significance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially discosed but simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is dismissed perfunctorily. As will be developed herein, the subject invention teaches, inter alia, how an initially untensed shadow mask can be utilized to screen color phosphors on the faceplate of a color television tube.

Other examples of the prior art practice of utilizing a tensioned grid-type structure in a cathode ray tube environment are described in the following U.S. Pat. Nos. 2,842,696, 2,905,845, 3,489,966, and 3,719,848.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved color cathode ray tube color selection electrode arrangement for use in a color cathode ray tube.

It is another general object of the invention to provide a method of making an improved color selection electrode.

It is a further object of the invention to provide a color television picture tube which, in utilizing the improved color selection electrode arrangement, offers significant economic advantages over prior art tubes.

It is also an object of the invention to provide a method of manufacturing a color television cathode ray tube which, in utilizing the improved color selection electrode, effects substantial economices over prior practice.

It is an object of the invention to provide a color selection electrode of the tensed type which has the anti-doming attribute of tension-type electrodes, but without the power handling limitations of prior art tension electrode systems.

It is still another object of the invention to provide an envelope-captivated tensed color selection electrode system having the advantages of such systems, yet which is readily adapted to conventional color tube photoscreening methods and apparatus.

DESCRIPTION OF A PREFERRED EMBODIMENT

Figure 1:
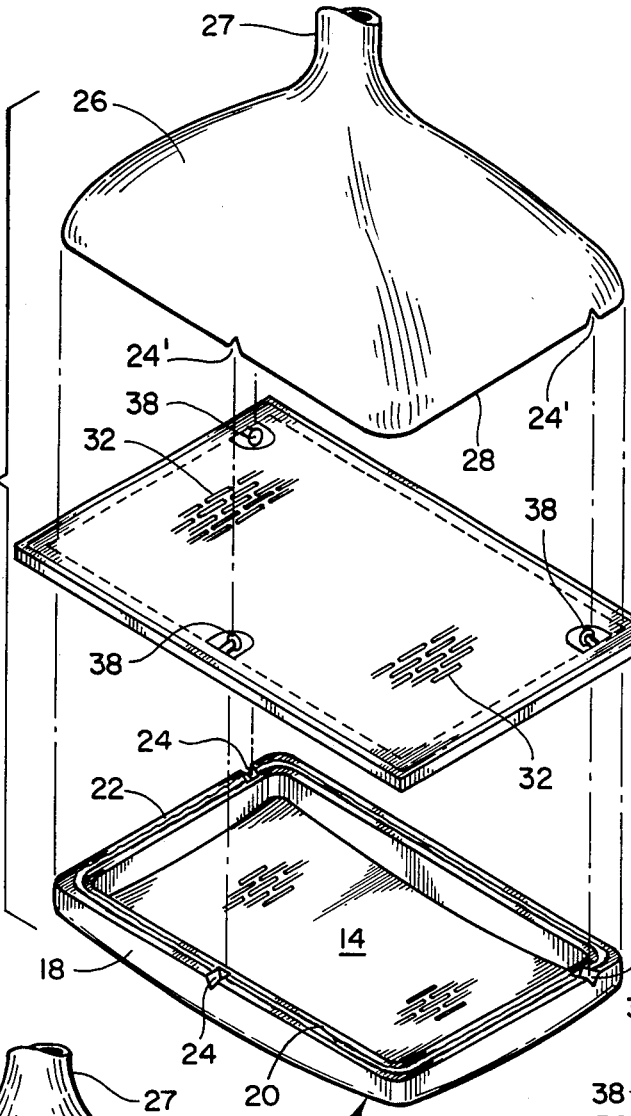
FIG. 1 is an exploded view, in perspective, of the principal components of a color cathode ray tube embodying the invention.

A color selection electrode assembly 10 constructed in accordance with a preferred embodiment of the invention, is shown in FIG. 1 associated with and forming an integral part of a color television cathode ray tube 12. Tube 12 is depicted therein in a perspective exploded format as an aid in visualizing the inventive concept. As will be described, electrode assembly 10 is utilizable as a stencil for use in screening a pattern of luminescent primary color elemental phosphor areas upon the target surface 14 of the envelope section 16 that comprises the faceplate of tube 12. In the disclosed embodiment, faceplate 16 is depicted as a glass panel formed of a material having a predetermined temperature coefficient of expansion and having a rearwardly extending skirt 18 that circumscribes target surface 14. The height of skirt 18 establishes the Q spacing for tube 12, that is, the distance between target surface 14 and its shadow mask, which, in the subject invention, comprises an apertured foil which is described in detail below. The end surface 20 of skirt 18, which is remote from facepanel 16, constitutes a sealing land, a surface for receiving a bead of frit 22, a devitrifying glass adhesive employed in fabricating cathode ray tubes. Preferably, the frit employed is a low-temperature solder glass material which is available from Owens-Illinois Inc. under their designation CV-130.

In any event, as will be shown, the electrode assembly 10, upon completion of its screening function, is thereafter, at the option of the practitioner, frit sealable to faceplate 16 to permit selective excitation of the primary color phosphors by a scanning electron beam(s) when that assembly forms a constituent of a color cathode ray tube. To this end, faceplate 16 is provided with registration affording means or alignment elements, which take the form of a plurality of V-grooves 24; in this execution they constitute three slots which are milled into the surface of the faceplate's sealing land 20. Preferably, the included angle defined by the sloping walls of grooves 24 approximate sixty degrees and they are oriented so that the bottom of each groove lies along a line that extends radially from the geometric center of the faceplate.

Figure 3:
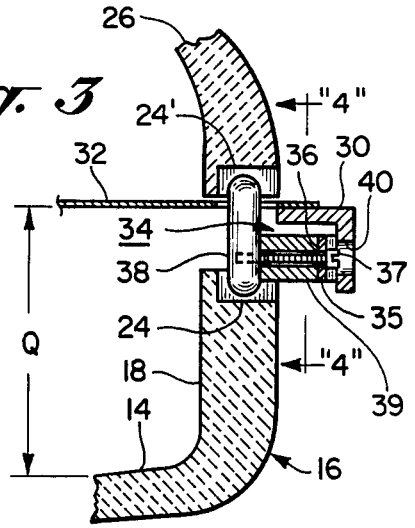
FIG. 3 is an enlarged sectional view of the encircled fragment of the tube shown in FIG. 2, in which elements of the tube and foil registration arrangements are detailed.

Moreover, it is of particular significance that V-grooves 24 do not extend completely across sealing land 20, see FIGS. 1 and 3. The depicted construction is resorted to in order to avoid a direct communication through skirt 18 of the faceplate which could compromise vacuum integrity once the faceplate has been frit sealed to electrode assembly 10 and to a funnel 26. While not entirely discernible in FIG. 1, funnel 26 has a sealing land 28 which geometrically matches faceplate sealing land 20. If desired, funnel sealing land 28 may be provided with a corresponding plurality of alignment elements (only two shown), which also take the form of V-grooves 24' milled into sealing land 28 and which are spatially aligned with the faceplate V-grooves 24. Recourse to V-grooves 24' is optional since it is appreciated that other means for aligning the funnel sealing land 28 with faceplate sealing land 20 are well known. In fact, a common practice is to use an "outside" reference system, that is, one in which the funnel is aligned to the face panel by positioning it against referencing snubbers. For sealing purposes, funnel land 28 receives a bead 22' of frit. Finally, faceplate 16, as well as funnel 26, which includes a neck 27, are formed of a material, e.g., a glass or ceramic composition, having a predetermined temperature coefficient of expansion and which is readily amenable to frit sealing techniques.

Figure 2:
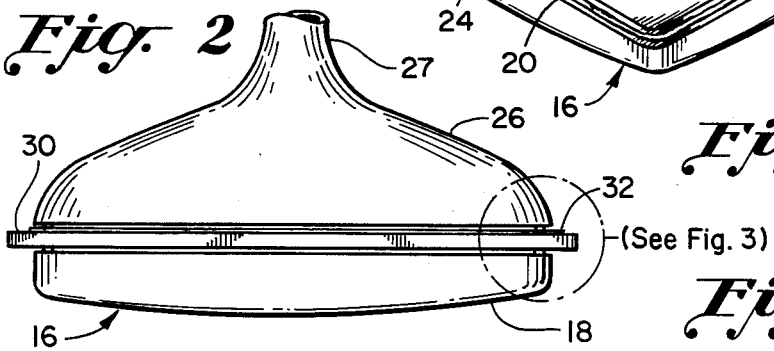
FIG. 2 is an elevational view of a partially assembled version of the tube shown in FIG. 1.

The color selection electrode arrangement 10 shown in FIG. 1 comprises an auxiliary severable mount 30 defining a central opening of sufficient span to enable the mount to surround the periphery of faceplate 16. Stated otherwise, the internal configuration of the mount essentially conforms to the periphery of the faceplate, see FIGS. 2 and 3. Mount 30, which adopts a rectangular configuration, is readily formed from four butt-welded strips of L-shaped angle metal. Strips of other geometry, of course, are also suitable. In any event, mount 30 is formed of a material having a temperature coefficient of expansion greater than that of envelope sections 16 and 26. Thus, mount 30 can be formed from cold rolled steel, stainless steel, nickel or monel to name a few of the materials found acceptable in practicing the invention.

Electrode assembly 10 further comprises, at this stage, an untensed planar foil 32 which has a predetermined pattern of apertures which may be triads of minute circular holes or, as now favored in state of the art color television tubes, a myriad of elongated narrow slots disposed perpendicular to the major axis of the foil. The foil is tautly drawn across the mount under the minimum tension required to render the foil planar and it is then secured to mount 30 by brazing or welding. In a manner to be described, foil 32 will subsequently be converted to a tension mask during the process employed to embody it as a constituent of a cathode ray tube. Foil 32 has a temperature coefficient of expansion which is not greater than that of mount 30 and, preferably, a temperature coefficient less than that of the mount. Thus, foil 32 can be formed from cold rolled steel, or invar, to name two substances, each of which are utilizable with mounts made from any of the above-mentioned mount materials.

Desirably, the thickness of foil 32 should be less than 2 mils (0.002 in.), otherwise unacceptable stresses will be induced in a faceplate when the foil is subsequently tensed and frit sealed to the faceplate. Preferably, a foil having a thickness equal to or less than 1 mil (0.001 in.) is most suitable in practicing the invention. In fact, when resort to electro-forming of foils is had, foils having a thickness of one-half mil (0.005 in.) or less are realizable and find practical application in the practice of the invention.

As can be appreciated, a precise repeatable, kinematic registration between foil mount 30 and faceplate 16 is essential in order to utilize foil 32 as a stencil in screening a pattern of different elemental phosphor areas upon target surface 14 of the faceplate.

Accordingly, to accomplish the aforesaid kinematic registration, mount 30 comprises indexing means in the form of a plurality of studs 34, one end of each being detachably secured to a resilient coupling, e.g., a leaf-type spring 35, apertured at 36, and having one end fixed to mount 30, see FIG. 3. The purpose of the resilient coupling 35 is to accommodate the difference in expansion, as between the envelope glass and the mount metal, when the assemblage is subsequently frit sealed. The studs are detachably secured to springs 35 in a manner that will readily permit a subsequent removal of the mount from the studs (after, of course, the foil has been severed from the mount) once the studs and the foil have been captivated between faceplate 16 and the funnel 26. For this purpose each stud 34 comprises a headed bolt 37, the distal end of which is threadably received in a rounded abutment which can take the form of a button or boss 38. These buttons or bosses comprise an alloy composition, the coefficient of expansion of which is compatible with the envelope glass. A glass sealable metal alloy suitable for this purpose is available from Carpenter Technology Corporation in Reading, Pa. under their designation 430TI. The shaft of bolt 37, which extends through spring aperture 36, is enclosed by a tubular spacer 39 which determines the spacing between spring 35 and button 38. Finally, that portion of mount 30 adjacent spring 35 is provided with a clearance hole 40 to provide access to bolt 37.

Figure 4:
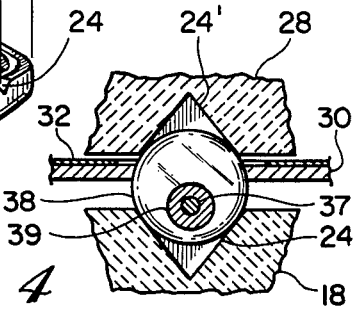
FIG. 4 is a fragmentary sectional view taken along lines 4—4 in FIG. 3.

The function of each boss is to cooperate with an assigned faceplate V-groove 24 during screening of the faceplate and, additionally, with an assigned V-groove 24' on the sealing land 28 of funnel 26 when the foil is finally integrated in tube 12. To this end, see FIGS. 3 and 4, boss 38 adopts a diameter such that when it is seated upon the inclined walls of faceplate groove 24 and/or funnel groove 24', the respective sealing lands 20 and 28 of the faceplate and funnel are maintained in a predetermined spaced-apart relation. This spacing, which can be in the order of five to ten mils (0.005–0.010 in.), depending, in part, upon the size of the tube, is provided to accommodate a subsequent application of the sealing frit 22. Insofar as this spacing is concerned, the illustrations in FIGS. 3 and 4, obviously, are not to scale; in fact, the depictions are intentionally exaggerated in order to permit a visualization of that spacing. Moreover, as shown in FIG. 3, this construction, in permitting foil 32 to be literally suspended between the sealing lands of the faceplate and the funnel, serves, in conjunction with panel skirt 18, to establish the Q spacing for the tube. At this juncture it should be noted that each boss makes a two-point contact with each groove it is received by, for a total six-point contact as between the mount and the faceplate and another six-point contact as between the mount and the funnel. It is appreciated, of course, that the registration format can be reversed, that is, the sealing lands can be provided with bosses or buttons while the mount is fitted with grooved elements for receiving the bosses.

Figure 5:
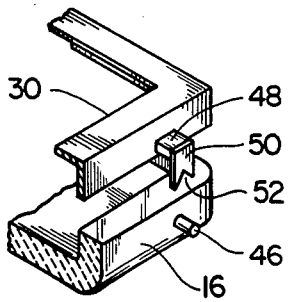
FIG. 5 is a fragmentary sectional view of a portion of a cathode ray tube depicting an alternative facepanel/-shadow mask registration arrangement.

On the other hand, an alternative registration arrangement for effecting a six-point contact between foil mount 30 and face panel 16 contemplates the "external" approach shown in FIG. 5. This aspect is described and claimed in U.S. patent application Ser. No. 538,001, of common ownership herewith. More particularly, as a registration affording means the face panel is fitted with three (only one shown) externally mounted, outwardly directed break-away pins 46 which, geometrically, adopt the same relative locations as those occupied by V-grooves 24 on the face panel shown in FIG. 1. Indexing means cooperating with each of the pins 46 comprises a tab 48 affixed to foil mount 30. Tab 48 has a depending finger 50 which, in turn, is provided with a bifurcation 52 at its distal end. Accordingly, to effect a kinematic registration with this embodiment, mount 30 is supported over the face panel with a finger bifurcation 52 poised over its assigned pin. When the mount is lowered, a six-point contact is established between the three pins 46 and their cooperating bifurcations 52. This registration between the foil mount and the face panel is repeatable as often as is required to accomplish screening of the target surface of the face panel, as well as to effect a final registration between the foil mount and the face panel prior to frit sealing. After the funnel and face panel have been frit sealed to bond foil 32 between their confronting sealing lands (a process described below) pins 46 may be broken away from the face panel. Moreover, it is appreciated that the physical locations of the pins and the bifurcated fingers can be reversed and that other indexing structure within the knowledge of one skilled in the art could be employed. Of course, a like external registration arrangement can be adopted, if desired, for aligning funnel 24 with the foil mount.

Figure 6:
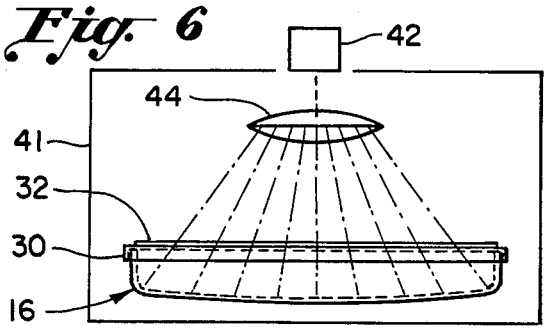
FIG. 6 is a schematic representation of a lighthouse arrangement for screening a cathode ray tube faceplate according to this invention.

There will now be described a process that utilizes electrode assembly 10, as a stencil, to screen a pattern of primary color elementary phosphor areas upon the target surface 14 of faceplate 16. A known and widely used method of preparing color phosphor screens utilizes a process which has developed from familiar photographic techniques. To this end, a slurry comprising a quantity of a primary color phosphor particles suspended in a photosensitive organic solution (pva), is applied, as a coating, to the target surface 14 of faceplate 16. Mount 30, with a taut, but untensed, foil attached thereto is then seated upon faceplate 16 by effecting a registration between stud bosses 38 and their assigned faceplate grooves 24. As schematically depicted in FIG. 6, the registered faceplate and electrode mount assemblage is then inserted in a lighthouse 41 comprising a source of light 42 actinic to the photosensitive coating. At any one instant light source 42 occupies a spatial position corresponding, in effect, to the axial position of the source of the electron beam that will subsequently excite the phosphor pattern to be created. Thereafter, in the ordinary practice wherein a conventional untensed mask is used as a stencil, the slurry coating would be exposed to actinic light rays that pass through a conventional beam trajectory compensating lens before encountering the mask apertures. The light transmitted through the mask then creates a latent image of the mask's aperture pattern on the coated faceplate.

However, for reasons to be developed, in practicing the subject invention this conventional exposure step requires modification. More particularly, it must be borne in mind that first, the instant screening process is utilizing an untensed foil and secondly, this untensed foil will subsequently be converted to a tension foil before it will be employed as a color selection electrode to address the patterned phosphor screen it stenciled when it was in its untensed state. The significance of this is that the apertures in a tensed foil are radially outwardly displaced from the spatial positions they occupied in the untensed foil so that, absent a provision to account for this spatial displacement of the foil apertures, the tensed foil would fail to effect a proper registration of the electron beam landing areas with the elemental phosphor areas of the screen it stenciled when it was untensed.

Accordingly, a change in the usual method of exposing a phosphor slurry to actinic light is called for. Specifically, refer again to FIG. 6, the light rays from actinic source 42 are directed through a special lens 44 which redirects the light rays before they traverse foil 32 so that they impinge the phosphor slurry at points radially outwardly from the points they would have, absent the lens. In other words, the lens serves to displace the light rays from their original paths so that, upon encountering the slurry, they create a latent image corresponding to the image that would be created if a tensed foil had been employed (sans lens) as the stencil.

As noted, in conventional screening techniques a lens is introduced between the light source and the stenciling mask in order to compensate for the fact that the trajectory of an electron beam under deflection differs from the path of a light ray originating from the same point source as the electron beam. Thus the reference to a "special" lens contemplates a lens which, in addition to effecting the aforementioned compensation, also introduces a correction that insures that a pattern screened by an untensed foil can later be addressed through a tensed foil. As a first order of correction, the light source is moved slightly forward so as to move the light landing areas radially outward. A second order of correction is to adopt a lens design to compensate for whatever error the physical forward displacement of the light source failed to correct.

Now, insofar as the design of this special lens is concerned, a suggested procedure entails initially exposing a coated substrate through an untensed foil and developing a pattern therefrom. Thereafter the untensed foil is subjected to a controlled laboratory heat environment until the foil develops the same aperture dimensions and locations that a foil develops when it undergoes the firt sealing process and goes into tension. The laboratory "grown" foil is then seized and maintained in its tensed state. This tensed foil can then be used to cast a pattern of light upon another substrate duplicate of faceplate 16, which pattern is then compared to the light pattern created by an untensed foil. This disparity, or difference, in aperture locations is then reverse engineered with the aid of a computer into a lens design. This lens, when employed in conjunction with an untensed mask, will now direct actinic light rays along paths which impinge the phosphor coating at those points where the light rays, sans lens, would have impinged the coating had they passed through a tensed mask. In practice, numbers of faceplates are screened in this fashion and then incorporated into cathode ray tubes. The screens are then illuminated to analyze beam landing areas and any discrepancies noted. Corrective information is then fed back into the lens design.

Since the necessary displacement of the latent image points calls for lens design formulas and exposure techniques very similar to those used conventionally, the development of the necessary correction lens 44, light source position(s) and exposure technique is well within the purview of state of the art practice.

Accordingly, after the initial exposure through lens 44, mount 22 and the foil are then removed and the substrate is washed. By way of example, in a positive resist, positive guardband system this wash will remove the exposed portion of the coating. However, it is to be appreciated that the invention is equally utilizable in a negative resist, negative guardband environment or even in the tacky-dot dusting system. In any event, the exposed coating is processed to establish upon target surface 14 a pattern of elemental phosphor areas, corresponding to the aperture pattern that would have resulted from using a tensed foil (sans special lens).

The slurry coating, foil mount registrations, exposure and wash steps are then repeated for each of the other primary color phosphor areas to be applied to target surface 14, with the source of actinic light, of course, disposed at appropriately different positions with respect to foil 24. The resultant luminescent screen comprises a pattern of interleaved primary color phosphor areas that would have been created by a tensed foil without use of special lens 44. In practice, successive repositioning of the light source, prior to exposing the target screen through the foil, is such as to effectively approximate the positions of three scanning electron beams issuing from a gun mount later to be fitted to the tube. In this regard, it should be noted that the resultant luminescent screen pattern will bear a unique geometric relationship, or orientation, to the light sources and, thereby, to the electron beam axes of the subsequently fitted electron gun mount.

After the screening process has been completed, desirably, the foil employed to pattern the screen is mated to the faceplate. In this process, the upwardly facing sealing land surface 20 of faceplate 16 and the downwardly facing land surface 26 of funnel 24 are coated with beads of low-temperature frit 22 after which mount 30 is re-registered with faceplate 16 by inserting bosses 38 in grooves 24. Funnel 26 is then fitted over the foil with its V-grooves 24' receiving stud bosses 38.

This assemblage is then inserted into a heat chamber, or oven, the temperature of which is elevated to approximately 430 degrees Centigrade and maintained thereat for thirty to forty-five minutes. These are the temperature and time parameters required to devitrify low-temperature Owens-Illinois type CV-130 frit material. As the temperature rises, faceplate 16 and funnel 26 will expand by an amount determined by their characteristic temperature coefficients of expansion. Simultaneously, mount 30 and foil 32 will also expand but, because of their greater temperature coefficients of expansion, their growth, relative to the faceplate and funnel, will be greater. By the time this assemblage has reached a temperature of 430 degrees Centigrade, and by the time the frit has devitrified, mount 30 and foil 32 will have stabilized their expansion, as will have the funnel and face panel.

When the frit has devitrified, foil 32 is captured therein between funnel 26 and the faceplate 16. Thereafter, as the assemblage cools down to room temperature and the materials return, or attempt to return, to their normal dimensions, foil 32 will be tensed by virtue of the captivating action of the funnel-faceplate frit junction which will prevent the foil from returning to its normal room temperature dimension. Thus the mask, which was "grown" by the heat attendant upon the frit sealing process, is trapped in tension and maintained thereafter by the divitrified frit joining the funnel and faceplate.

With foil 32 now in a tensed state, the foil apertures occupy different spatial positions than they did when the foil was in its original untensed state. However, since the screen phosphor pattern was created in conjunction with lens 44, that simulated the light pattern that would be transmitted by a tensed foil, all as discussed above, the tensed foil will be in registration with the phosphor pattern.

After the faceplate, foil and funnel have been frit assembled, mount 30 is removed from the captivated foil by first severing the foil along the inside perimeter of the mount. Then the stud bolts 37 are unscrewed from their bosses 38, which have been sealed into the V-grooves of the face panel and the funnel with the devitrifying frit, thus permitting removal of mount 30 from the assemblage. (The mount, of course, is reuseable.) Thereafter, an electron gun assembly is inserted into the neck portion of the funnel and sealed thereto to provide a color cathode ray tube embodying a novel color selection electrode. The foil is trimmed as close to the perimeter of the faceplate-funnel junction as possible. After the exhaust process, the face panel-funnel junction is covered with a coating of insulating material to prevent external contact with the foil which, depending upon the excitation system utilized with the completed tube, may be maintained at a high electrical potential.

It is to be noted that the alignment elements utilized by the faceplate and funnel, as well as the indexing means used for the foil mount need not be restricted to the groove and boss format disclosed. Moreover, materials other than those disclosed for the envelope sections and the mount and foil can be used so long as the coefficients of expansions of such materials provide the differential expansion required to tense an initially untensed foil.

While particular embodiments of the invention have been shown and described, it will be obvious to those skilled in the art that changes and modifications may be made without departing from the invention in its broader aspects, and, therefore, the aim of the appended claims is to cover all such changes and modifications as fall within the true spirit and scope of the invention.

I claim:

1. A color cathode ray tube comprising:

a funnel having a sealing land;

a faceplate comprising a target surface having a pattern of luminescent primary color elemental phosphor areas deposited thereon and a sealing land circumscribing said target surface and geometrically matching said funnel sealing land, said faceplate sealing land having a plurality of alignment grooves selectively located and oriented thereon;

a color selection electrode affording selection of said phosphor areas by a scanning beam of electrons comprising:

a planar tensed foil, having a predetermined pattern of color selection apertures and having a temperature coefficient of expansion greater than that of said funnel and said faceplace, the periphery of said foil extending across said sealing lands;

indexing means comprising a like plurality of rounded elements geometrically fixedly associated with said foil and individually cooperable with an assigned one of said alignment grooves of said faceplate to form a like plurality of two-point contacts between said faceplate and said color selection electrode for establishing a precise kinematic registration between said foil apertures and said elemental phosphor areas of said target surface; and devitrifying frit means disposed between said funnel sealing land and said faceplate sealing land and in intimate contact with said foil periphery for bonding said funnel to said faceplate, for securing said foil between said sealing lands and for maintaining said foil in tension.

2. A color cathode ray tube as set forth in claim 1 in which said faceplate comprises a glass panel having a skirt extending rearwardly from the target surface thereof.

3. A color cathode ray tube as set forth in claim 2 in which said skirt has a height that establishes the Q spacing, that is, the spacing between said faceplate and said foil.

4. A color cathode ray tube as set forth in claim 2 in which the end surface of said skirt remote from said faceplate comprises said faceplate sealing land.

* * * * *